US009776449B2

(12) United States Patent
Shimura et al.

(10) Patent No.: US 9,776,449 B2
(45) Date of Patent: Oct. 3, 2017

(54) POST-PROCESSING APPARATUS AND IMAGE FORMING SYSTEM INCLUDING THE POST-PROCESSING APPARATUS

(71) Applicant: CANON KABUSHIKI KAISHA, Tokyo (JP)

(72) Inventors: Hiromi Shimura, Toride (JP); Keita Takahashi, Abiko (JP); Hiroto Nishihara, Tsukuba (JP); Shinnosuke Iwadate, Toride (JP); Teruhito Kai, Kashiwa (JP); Kenzo Kumagai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 155 days.

(21) Appl. No.: 14/870,560

(22) Filed: Sep. 30, 2015

(65) Prior Publication Data

US 2016/0096391 A1 Apr. 7, 2016

(30) Foreign Application Priority Data

Oct. 2, 2014 (JP) ..... 2014-204184
Sep. 15, 2015 (JP) ..... 2015-181610

(51) Int. Cl.
*B42C 1/12* (2006.01)
*G03G 15/00* (2006.01)

(52) U.S. Cl.
CPC ..... *B42C 1/12* (2013.01); *G03G 15/6544* (2013.01); *B65H 2408/122* (2013.01); *B65H 2408/1222* (2013.01); *B65H 2408/1223* (2013.01); *G03G 2215/00827* (2013.01)

(58) Field of Classification Search
CPC ..... G03G 15/6544; B65H 2408/1223; B65H 2408/122; B65H 2408/1222; B42C 1/12
See application file for complete search history.

(56) References Cited

U.S. PATENT DOCUMENTS 7,568,510 B2 8/2009 Nagaya et al.
9,323,205 B2 * 4/2016 Mine ..... G03G 15/6544
2011/0031677 A1 * 2/2011 Ozawa ..... B65H 29/34 270/58.12

FOREIGN PATENT DOCUMENTS

JP 2009-018932 A 1/2009
JP 2009018932 A * 1/2009
JP 2010116267 A * 5/2010 ..... B42B 4/00

OTHER PUBLICATIONS

U.S. Appl. No. 14/789,133, filed Jul. 1, 2015.

* cited by examiner

*Primary Examiner* — Jennifer Simmons
(74) *Attorney, Agent, or Firm* — Fitzpatrick, Cella, Harper & Scinto

(57) ABSTRACT

A post-processing apparatus which can respectively balance convenience of user using a manual stapling and convenience of user using an online stapling is provided. The finisher includes a stapler for performing predetermined post-processing on a sheet received and a control unit. The finisher also includes a stapler moving motor which moves the stapler to a position where first processing or second processing is performed. In the first processing, the predetermined post-processing is performed on a sheet which is conveyed from an image forming apparatus. In the second processing, the predetermined post-processing is performed on a sheet which is manually inserted.

15 Claims, 10 Drawing Sheets

| TYPES OF OPERATION OF IMAGE FORMING APPARATUS | TIME PERIOD REQUIRED |
|---|---|
| SHEET DELIVERY INTERVAL (SMALL SIZE, SINGLE-SIDED) | 2 SEC. |
| SHEET DELIVERY INTERVAL (SMALL SIZE, DOUBLE-SIDED) | 4 SEC. |
| SHEET DELIVERY INTERVAL (LARGE SIZE, SINGLE-SIDED) | 5 SEC. |
| SHEET DELIVERY INTERVAL (LARGE SIZE, DOUBLE-SIDED) | 10 SEC. |
| PREPARING IMAGE FORMATION (SHORT) | 3 SEC. |
| PREPARING IMAGE FORMATION (LONG) | 10 SEC. |
| ADJUSTING DEVELOPING DEVICE | 10 SEC. |
| ADJUSTING LASER SCANNER UNIT | 10 SEC. |

FIG. 7A

| TIME PERIOD FOR MOVEMENT OF STAPLER | | MOVING DESTINATION | | | | | |
|---|---|---|---|---|---|---|---|
| | | HOME POSITION | MANUAL STAPLING POSITION | CORNER BINDING FRONT POSITION | DOUBLE BINDING FRONT POSITION | DOUBLE BINDING REAR POSITION | CORNER BINDING REAR POSITION |
| MOVING SOURCE | HOME POSITION | 0 SEC. | 0.5 SEC. | 1 SEC. | 2 SEC. | 2.5 SEC. | 3 SEC. |
| | MANUAL STAPLING POSITION | 0.5 SEC. | 0 SEC. | 0.5 SEC. | 1.5 SEC. | 2 SEC. | 2.5 SEC. |
| | CORNER BINDING FRONT POSITION | 1 SEC. | 0.5 SEC. | 0 SEC. | 1 SEC. | 1.5 SEC. | 2 SEC. |
| | DOUBLE BINDING FRONT POSITION | 2 SEC. | 1.5 SEC. | 1 SEC. | 0 SEC. | 0.5 SEC. | 1 SEC. |
| | DOUBLE BINDING REAR POSITION | 2.5 SEC. | 2 SEC. | 1.5 SEC. | 0.5 SEC. | 0 SEC. | 0.5 SEC. |
| | CORNER BINDING REAR POSITION | 3 SEC. | 2.5 SEC. | 2 SEC. | 1 SEC. | 0.5 SEC. | 0 SEC. |

FIG. 7B

| TYPES OF BIDING | TIME PERIOD REQUIRED |
|---|---|
| CORNER BINDING | 1 SEC. |
| DOUBLE BINDING | 2.5 SEC. |

FIG. 7C

POST-PROCESSING APPARATUS AND IMAGE FORMING SYSTEM INCLUDING THE POST-PROCESSING APPARATUS

BACKGROUND OF THE INVENTION

Field of the Invention

The present disclosure relates to a post-processing apparatus for binding a sheet bundle formed of a plurality of sheets and an image forming system comprising the post-processing apparatus.

Description of the Related Art

Conventionally, as an optional device for the image forming apparatus, a sheet processing apparatus which receives sheets delivered from the image forming apparatus and performs stapling post processing on the sheet bundle received (post-processing apparatus) is commonly used. Further, some of the sheet processing apparatuses of this kind include functions such as an online stapling function, which is automatically executed as a part of a print job, and a manual stapling function, through which a user manually inserts a sheet bundle into an opening which is open outside the apparatus and performs stapling processing on the sheet bundle. In such a sheet processing apparatus, in addition to the online stapling function, it is required to have the manual stapling function as an additional function and reduce cost needed to manufacture the sheet processing apparatus body.

For example, Japanese Patent Application Laid-open No. 2009-018932 discloses a sheet post-processing device, in which a stapling device is configured to be movable to a first position where online stapling processing is performed and to a second position where manual stapling processing is performed. As a result, one stapler device, which is expensive, can commonly be used both in an online stapling function and in a manual stapling function. This enables to reduce manufacturing cost of the sheet processing apparatus body and provide an additional value to a user.

On the other hand, the sheet post-processing device as disclosed in Japanese Patent Application Laid-open No. 2009-018932 does not optimize user's waiting time caused when selectively using the manual stapling function and the online stapling function which accompanies a print job, which is a problem. It is noted that the print job which uses the online stapling function is hereinafter referred to as an online stapling job. For example, in the conventional apparatus, when an instruction to execute the online stapling job is received, the stapler device is moved to the online stapling position. Thereby, if an instruction to execute manual stapling is received while the online stapling job is being executed, the time period for the stapler device to move from an online stapling position to a manual stapling position is required. That is, in a case where the time period for executing the manual stapling including the time period for movement is longer than the time period to an online stapling operation which is next executed, waiting time is caused in either the online stapling job or the manual stapling.

Further, in a case where the execution of the online stapling job is prioritized, the waiting time is caused for the user of the manual stapling. On the other hand, in a case where an immediate execution of the manual stapling is prioritized, completion of the online stapling job will be late. As mentioned, it is preferable that the time period required to execute the manual stapling including the time period for movement of the stapling device is as short as possible.

SUMMARY OF THE INVENTION

A post-processing apparatus of the present disclosure comprises: a post-processing unit configured to perform predetermined post-processing on a sheet; a moving unit configured to move the post-processing unit to a first processing position where first processing is performed or to a second processing position where second processing is performed, wherein in the first processing, the predetermined post-processing is performed on a sheet which is conveyed from an image forming apparatus, and in the second processing, the predetermined post-processing is performed on a sheet which is manually inserted; and a control unit configured to control the post-processing unit to start moving after a difference in time between a first time period and a second time period is elapsed in a case where the first time period, which is a time period to next execution of the predetermined post-processing in the first processing, is greater than the second time period, which is a time period for the post-processing unit to move to the first processing position.

Further features of the present invention will become apparent from the following description of exemplary embodiments (with reference to the attached drawings).

BRIEF DESCRIPTION OF THE DRAWINGS

FIGS. 7A to 7C are tables indicating the time period for each operation of the image forming system.

DESCRIPTION OF THE EMBODIMENTS

Now, In the following, embodiments are described with reference to the accompanying drawings.

Figure 1:
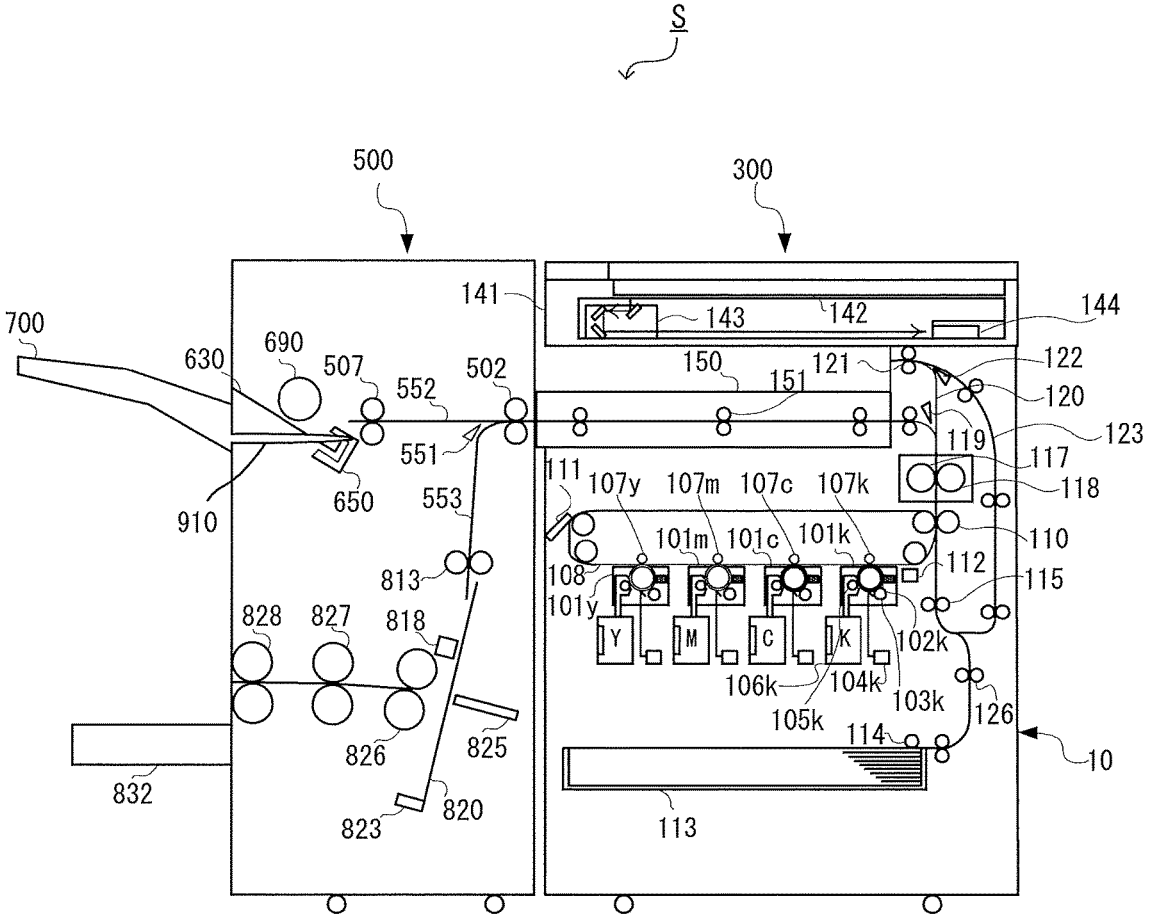
FIG. 1 is a schematic longitudinal sectional view illustrating one example of a configuration of an image forming system including an image forming apparatus and a finisher, which is one example of a post-processing apparatus.

FIG. 1 is a schematic longitudinal sectional view illustrating one example of a configuration of an image forming system including an image forming apparatus and a finisher which is one example of a post-processing apparatus according to the present embodiment. An image forming apparatus 300 of an image forming system S shown in FIG. 1 comprises a printer section 10. The printer section 10 comprises process units 101*k*, 101*y*, 101*m*, and 101*c*, which respectively correspond to black, yellow, magenta, and cyan colors. It is noted that each process unit comprises a photosensitive drum, a developing device, a charging roller, and the like. In the following, description is given with regard to a photosensitive drum 102*k*, a charging roller 103*k*, a developing device 105*k* and the like included in the process unit 101*k* for black.

The photosensitive drum 102*k* is arranged at a center of the process unit 101*k* shown in FIG. 1, which is rotated and driven by a drum motor (not shown). The charging roller 103 uniformly charges the surface of the photosensitive drum 102*k* by applying high voltage thereto. A laser scanner unit 104*k* scans a laser, which is modulated and output from a laser diode, in a longitudinal direction using a polygon mirror rotator. Thereby, laser is exposed on the uniformly charged photosensitive drum 102*k* according to input image information to form an electrostatic latent image. The developing device 105*k* forms a visible toner image according to the electrostatic latent image on the photosensitive drum using two component developer including a toner and a carrier. A toner bottle 106*k* is a bottle in which toner is filled, which supplies the toner to the developing device 105*k*. A primary transfer roller 107*k* transfers the toner image formed on the photosensitive drum 102*k* to an intermediate transfer body 108.

It is noted that the process units 101*y* to 101*c* are identically formed to the process unit 101*k*. It is noted that the photosensitive drum 102, the charging roller 103, and the developing device 105 in the following description mean to include the components of each color, yellow, magenta, cyan and black.

The toner image having transferred to the intermediate transfer body 108 is transferred to a sheet (for example, paper) by a secondary transfer roller 110. It is noted that any residual toner having failed to be transferred by the secondary transfer roller 110 or the toner image not intended to be transferred on the paper but used to adjust image quality is cleaned by an intermediate transfer member 111. A pattern density sensor 112 detects variation of pattern density imaged on the intermediate transfer member. The image quality adjustment is performed by feeding back detection result from the pattern density sensor 112 to the developing device 105, the laser scanner unit 104 and the like.

The sheet is stored in a sheet cassette 113. When the toner image is transferred to the sheet, a sheet feeding roller 114 feeds the sheet at timing at which the toner image matches a sheet edge. Thereafter, skew feeding of the sheet is corrected by a registration roller 115. Then, the sheet is sent to the secondary transfer roller 110.

The toner is fixed to the sheet having the toner image transferred by the fixing roller 117 and a pressurizing roller 118. A sheet conveying direction is switched by a delivery flapper 119. When a single-sided mode, by which the image is formed on one side of the sheet, is set, the sheet having the toner fixed is conveyed to an intermediate conveying unit 150. Further, when double-sided mode, by which the image is formed on both sides of the sheet, is set, the sheet having the toner fixed is conveyed to a double-sided sheet surface reverse path 120. The sheet conveyed to the double-sided sheet surface reverse path 120 goes through a double-sided conveying path 123 by a reverse roller 121 and a reverse flapper 122. Then, the sheet is conveyed to the registration roller 115. Then, the image is formed on a back surface of the sheet. Thereafter, the sheet is further conveyed to the intermediate conveying unit 150. Thereafter, the sheet is conveyed to a finisher 500 via an intermediate conveying roller 151 of the intermediate conveying unit 150.

[Finisher]

The finisher 500 shown in FIG. 1 performs processing for taking in the sheet conveyed from the printer section 10, aligning a plurality of sheets taken in and bundling the plurality of sheets as one sheet bundle and processing for stapling a rear edge of the sheet bundle (stapling processing). It means that the finisher 500 performs predetermined post-processing on the sheet received from the image forming apparatus 300. In addition, the finisher 500 has an online post-processing function for performing post-processing on the sheet including sorting processing, non-sorting processing and bookbinding processing. The finisher 500 also has a manual stapling processing function for performing stapling processing on the sheet bundle which is manually inserted through an opening 910. It is noted that an opening sheet bundle sensor 909 (described later) is arranged on a predetermined position of the opening 910, which detects whether the sheet bundle is manually inserted or not. In the following, description is given with regard to the online post-processing function of the finisher 500.

As shown in FIG. 1, the finisher 500 comprises inlet roller pair 502 for taking the sheet conveyed from the printer section 10 in the apparatus. A switching flapper 551 for guiding the sheet to a path 552 or a path 553 is arranged on a downstream side of the inlet roller pair 502. When, for example, the post-processing other than the bookbinding processing is performed, the switching flapper 551 guides the sheet to the path 552 shown in FIG. 1. The sheet guided to the path 552 is delivered to an intermediate tray 630 via a conveyance roller 507. The sheet delivered to the intermediate tray 630 is aligned by an alignment plate (not shown) which is arranged at both sides in a width direction which is orthogonal to the sheet conveying direction and by a bundle delivery roller 690. If it is set to perform the stapling processing, after the number of sheets of one sheet bundle is conveyed, the stapling processing is performed on the sheet bundle by a stapler 650. Thereafter, the sheet bundle is delivered on the delivery tray 700 through the bundle delivery roller 690.

Further, when the bookbinding processing is performed, the switching flapper 551 guides the sheet to the path 553 shown in FIG. 1. The sheet guided to the path 553 is stored in a storing guide 820 through a conveyance roller 813. It is noted that the sheet which is conveyed by the conveyance roller 813 is conveyed till a leading edge of the sheet contacts a movable sheet positioning member 823.

Further, two pairs of staplers 818 are arranged on a downstream side of the conveyance roller 813, i.e., in the middle position of the storing guide 820. Thereby, two positions at the center of the sheet bundle in the sheet conveying direction can be stapled. It is noted that, to match the stapling position of the sheet bundle stapled by the stapler 818 with a center position (nip point) of a folding roller pair 826, the positioning member 823 lowers by a predetermined distance from a position at which the stapling processing is performed on the sheet bundle. Thereby, centering the position at which the stapling processing is performed, the sheet bundle can be folded.

The folding roller pair 826 is arranged on the downstream of the stapler 818. A thrusting member 825 is arranged to face the folding roller pair 826. The thrusting member 825 thrusts the sheet bundle stored in the storing guide 820. Thereby, the sheet bundle is pushed between the folding roller pair 826 and conveyed while being folded by the folding roller pair 826. Then, the folded sheet bundle passes through an intermediate roller 827 and a delivery roller 828. Then, the sheet bundle is delivered on a delivery tray 832.

[Configuration of Control Unit]

Figure 2:
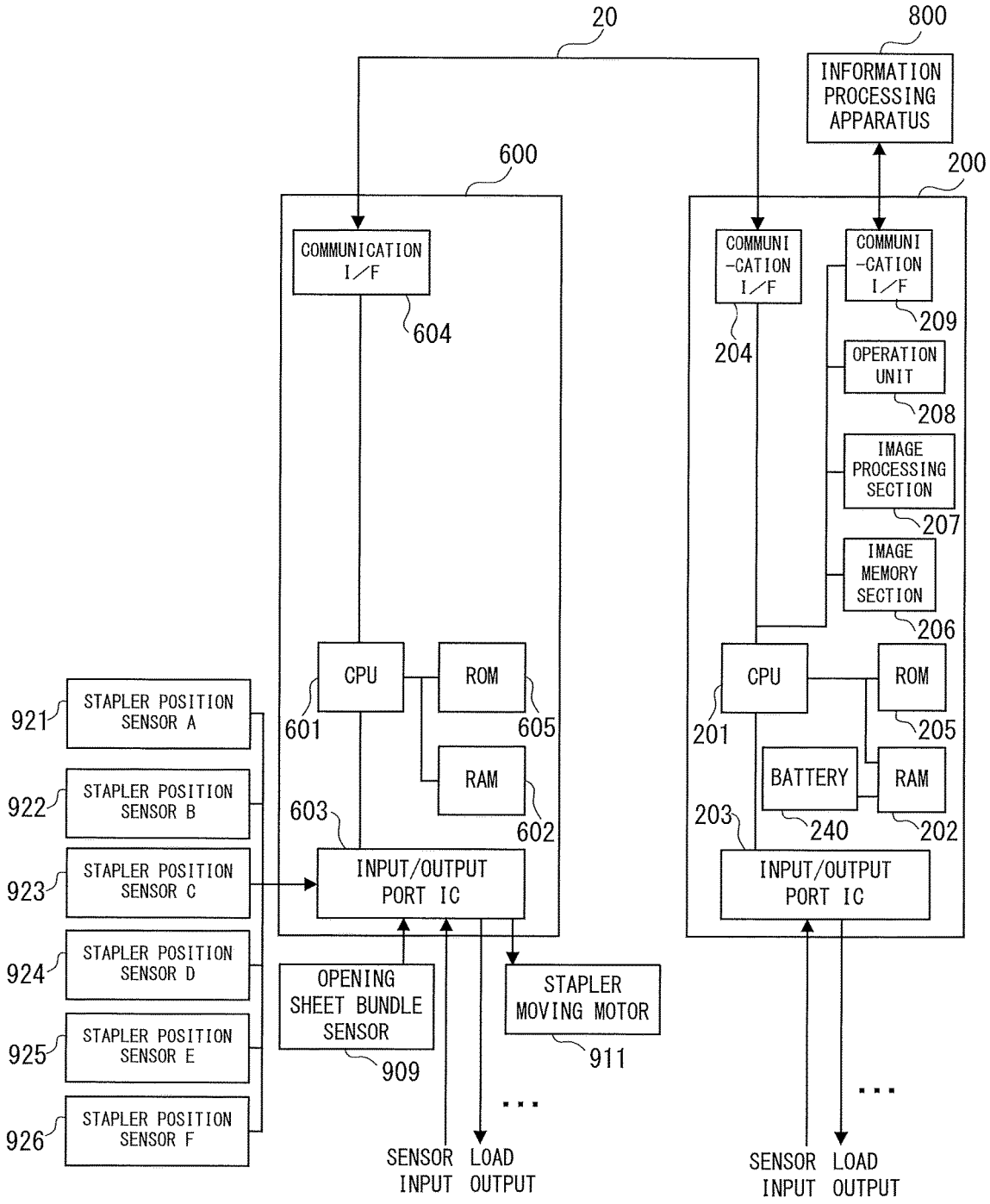
FIG. 2 is a block diagram for explaining each configuration of a control unit for controlling a printer section and a control unit for controlling the finisher.

FIG. 2 is a block diagram for explaining each configuration of a control unit 200 for controlling a printer section 10 and a control unit 600 for controlling a finisher 500. It is noted that the control unit 200 and the control unit 600 are connected to each other via a communication cable 20 so that information can be transmitted and received bidirectionally.

The control unit 200 comprises a CPU (central processing unit) 201 for performing basic control of the printer section 10 and a read only memory (ROM) 205 in which control program or application program is stored. The control unit 200 further comprises a random access memory (RAM) 202 which works as a work area for executing processing of the control program. The control unit 200 further comprises an input/output port IC 203, a communication interface 204, an image memory section 206 for storing image data, an image processing section 207 for processing an image signal which is converted into an electric signal. The control unit 200 further comprises an operation unit 208, a communication interface 209, and a battery 240. It is noted that the battery 240 is connected to the RAM 202. Thereby, data in the RAM 202 is held even when, for example, the printer section 10 is powered off. The input/output port IC 203 is connected to the CPU 201 via an address bus and a data bus.

According to the contents of the control program stored in the ROM 205, the CPU 201 receives signals which are output from sensors and the like (not shown) via the input/output port IC 203 and outputs control signals to various loads such as motors, clutches and the like (not shown). Thereby, the CPU 201 controls sheet conveyance, image formation on the sheet and the like. Also, the CPU 201 transmits/receives control data to/from the control unit 600 via the communication interface 204 and the communication cable 20. Thereby, the CPU 201 can control the delivery of the sheet having the image formed thereon between the image forming apparatus 300 and the finisher 500. Also, the CPU 201 can control a delivery accessory device such as state display.

The CPU 201, connected to the operation unit 208 for receiving an operation input from the user, controls display of a display section of the operation unit 208 and receipt of key input. Through the key input in the operation unit 208, the user instructs the operation mode of the printer section 10 and instructs to switch the display of the operation unit 208. It is noted that, for example, the operation state of the printer section 10, operation mode set by the key input and the like are displayed on the display section of the operation unit 208.

Further, the control unit 200 is connected to an information processing apparatus 800 via the communication interface 209. The CPU 201 controls to store the image data transferred from the information processing apparatus 800 in the image memory section 206 and causes the image processing section 207 to perform the image processing on the image data.

Further, every time image formation is performed on a predetermined number of sheets, the CPU 201 performs an image quality adjustment to keep quality of the image output from the printer section 10. To adjust the image quality, the CPU 201 first forms a toner pattern on the intermediate transfer member 108. Then, the CPU 201 detects density of the toner pattern through the pattern density sensor 112. Then, depending on a detection result, the CPU 201 adjusts the toner density in the developing device 105 or laser intensity output from the laser scanner unit 104. By doing so, the image quality is adjusted. Further, the CPU 201 counts the number of sheets having performed the image formation from the previous image quality adjustment. This enables to estimate the remaining number of sheets subjected to the image formation before the image quality adjustment is performed. The count numerical value indicating the remaining number of sheets subjected to the image formation before the image quality adjustment is executed is hereinafter referred to as an image quality adjustment counter. When the image quality adjustment is executed, a counter is initialized to a value which is identical to a predetermined number of sheets which is an interval at which the image quality adjustment is performed. Then, the value is subtracted every time the image formation is performed on a sheet. This is the image quality adjustment counter. Also, by transmitting/receiving control data to/from the control unit 600 via the communication interface 204 and the communication cable 20, the CPU 201 then controls sheet delivery and a delivery accessory device such as state display.

Here, description is given with regard to information, through which the CPU 201 communicates with the control unit 600, included in the control data. The control data includes various types of information including types of online post-processing, the number of sheets of one sheet bundle subjected to the online post-processing, sheet size, operation state of the printer section 10. The operation state of the printer section 10 includes "image formation being prepared", "image being formed", "image quality being adjusted" and the like, which vary depending on a state of sensor and operating condition of various loads. Further, the CPU 201 measures elapsed time period from the start of operation of each state. The elapsed time period is also included in the control data, through which the CPU 201 communicates with the control unit 600. Further, the image quality adjustment counter as mentioned is also included in the control data.

The control unit comprises a CPU 601 which performs basic control of the finisher 500, a ROM 605 in which control program or application program is stored, and a RAM 602 which works as a work area for executing processing of the control program. The control unit 600 further comprises an input/output port IC 603, and a communication interface 604. It is noted that the input/output port IC 603 is connected to the CPU 601 via and address bus and a data bus.

The CPU 201 receives signals output from sensor and the like (not shown) via the input/output port IC 603 according to the contents of the control program stored in the ROM 605 and outputs control signals to various loads such as motors, clutches and the like (not shown). Thereby, the CPU 201 controls sheet conveyance, post-processing on the sheet and the like. Further, the opening sheet bundle sensor 909, stapler moving motor 911, various sensors and the like are connected to the input/output port IC 603. The CPU 601 transmits/receives control data to/from the control unit 200 via the communication interface 604. Thereby, operation control of the online post-processing function including delivery of the sheet which is conveyed from the printer section 10, post-processing and the like are performed based on, for example, notification of the online job.

Further, the CPU 601 counts an order of the sheet delivered from the printer section 10 from a head sheet of the sheet bundle subjected to the online post-processing. Then, the counted value is stored in the RAM 602 as the number of delivered sheets. Next, description is given with regard to the processing position of the stapler 650 and movement of the stapler 650 to the processing position in a case where the online stapling is performed.

Figure 3:
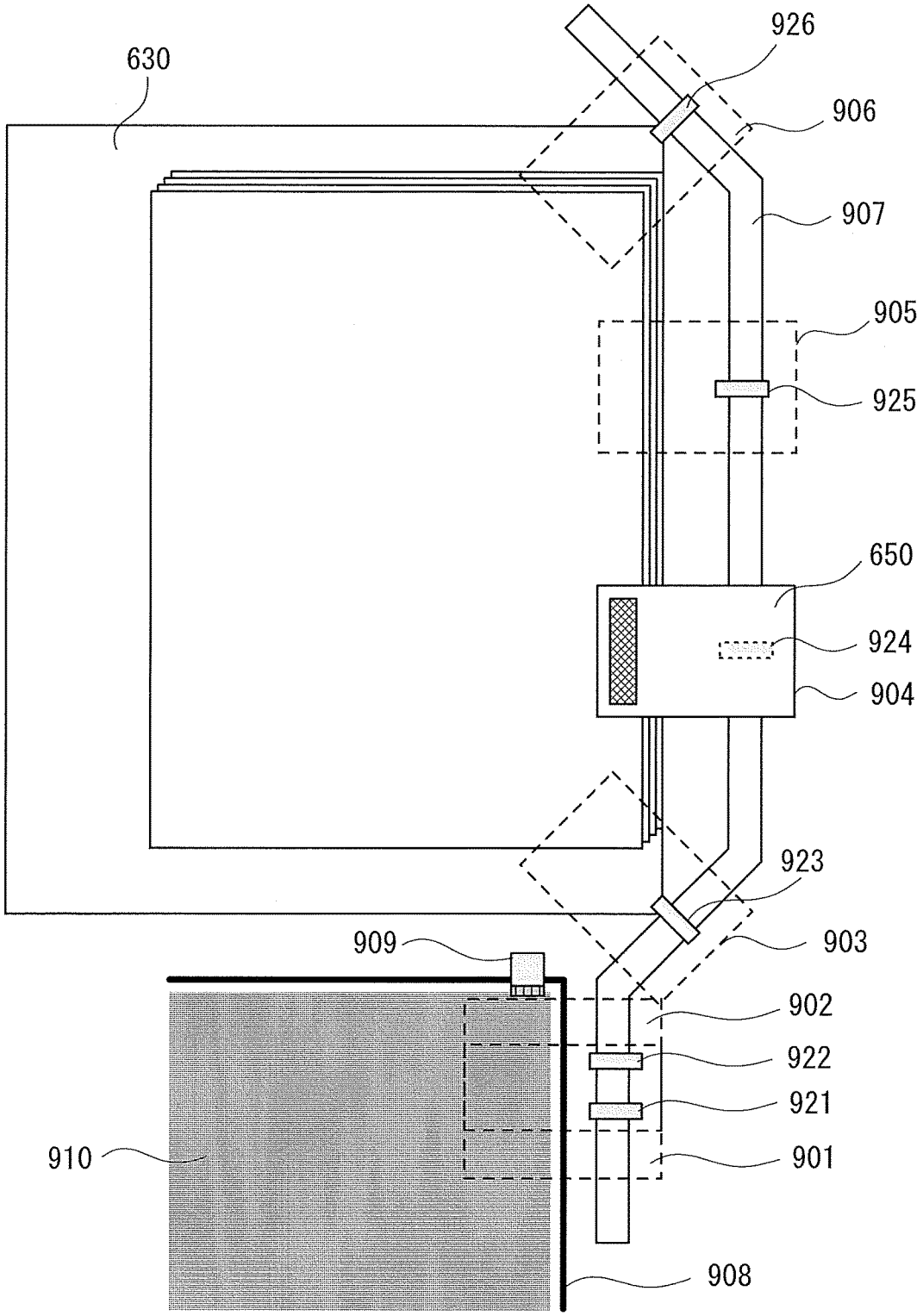
FIG. 3 is a top view illustrating one example of a configuration of a stapling section including a stapler.

FIG. 3 is a top view illustrating one example of a configuration of a stapling section including the stapler 650. By driving a stapler moving belt (not shown) by a stapler moving motor 911, the stapler 650 is configured to be movable along with a guide rail 907. Further, the stapler 650 is configured not to interfere sheet conveyance in the path 552 while it moves, sheet delivery on the intermediate tray 630 and the like. Further, the stapler 650 is configured to allow execution of the post-processing when performing the online stapling. The post-processing to be performed includes corner binding, by which a corner of the sheet is bound, double stapling, by which two portions of the rear edge of the sheet are bound and the like. Further, a position where the stapler 650 stops on the guide rail 907 includes a home position 901, a corner binding front position 903, a double binding front position 904, a double binding rear position 905, a corner binding rear position 906 and the like. As above, the stapler 650 stays at the respective processing position according to the contents of the post-processing. It is noted that FIG. 3 shows a state where the stapler 650 is staying at the double binding front position 904.

Also, a stapler position sensor (hereinafter referred to as position sensor) for detecting a stay of the stapler 650 is arranged at each binding position. A position sensor A 921 is arranged at a home position 901. A position sensor B 922 is arranged at a manual stapling position 902, which is described later. Also, a position sensor C 923 is arranged at the corner binding front position 903. A position sensor D 924 is arranged at the double binding front position 904. A stapler position sensor E 925 is arranged at the double binding rear position 905. Also, a stapler detection position sensor F 926 is arranged at the corner binding rear position 906. Depending on the detection state of these position sensors, the CPU 601 controls to drive the stapler moving motor 911 to stop the stapler 650 at an arbitrary binding position.

For example, in a case where the stapler 650 is moved from the home position 901 to the double binding front position 904, the CPU 601 instructs the stapler moving motor 911 to start driving via the input/output port IC 603. Thereafter, the CPU 601 receives a detection result of a position sensor D924 via the input/output port IC 603 and instructs the stapler moving motor 911 to stop driving. Thereby, the stapler 650 becomes ready to execute the binding processing (post-processing) at the double binding front position 904. The stapler 650 is stopping at the double binding front position 904 until the binding processing is performed. It is noted that, the movement of the stapler 650 to each position 901 to 906 is also controlled by the CPU 601 in a similar manner as above. It is noted that the stapler 650 is controlled to stop at the home position 901 in a normal state, move to the position according to the instruction of the binding position (902 to 906) to perform the binding processing, and go back to the home position 901 after performing the binding processing.

For example, in case of the corner binding, the stapler 650 stays at the binding position and continues the binding processing to the end of the online stapling job. Also, in case of the double binding, the stapler 650 reciprocally moves between the two double binding positions and performs the binding processing twice on one sheet bundle. Next, description is given with regard to performing manual stapling by the stapler 650. It is noted that description is given here in a case where an execution of manual stapling is instructed in a state where an online stapling job is not being executed.

Figure 4:
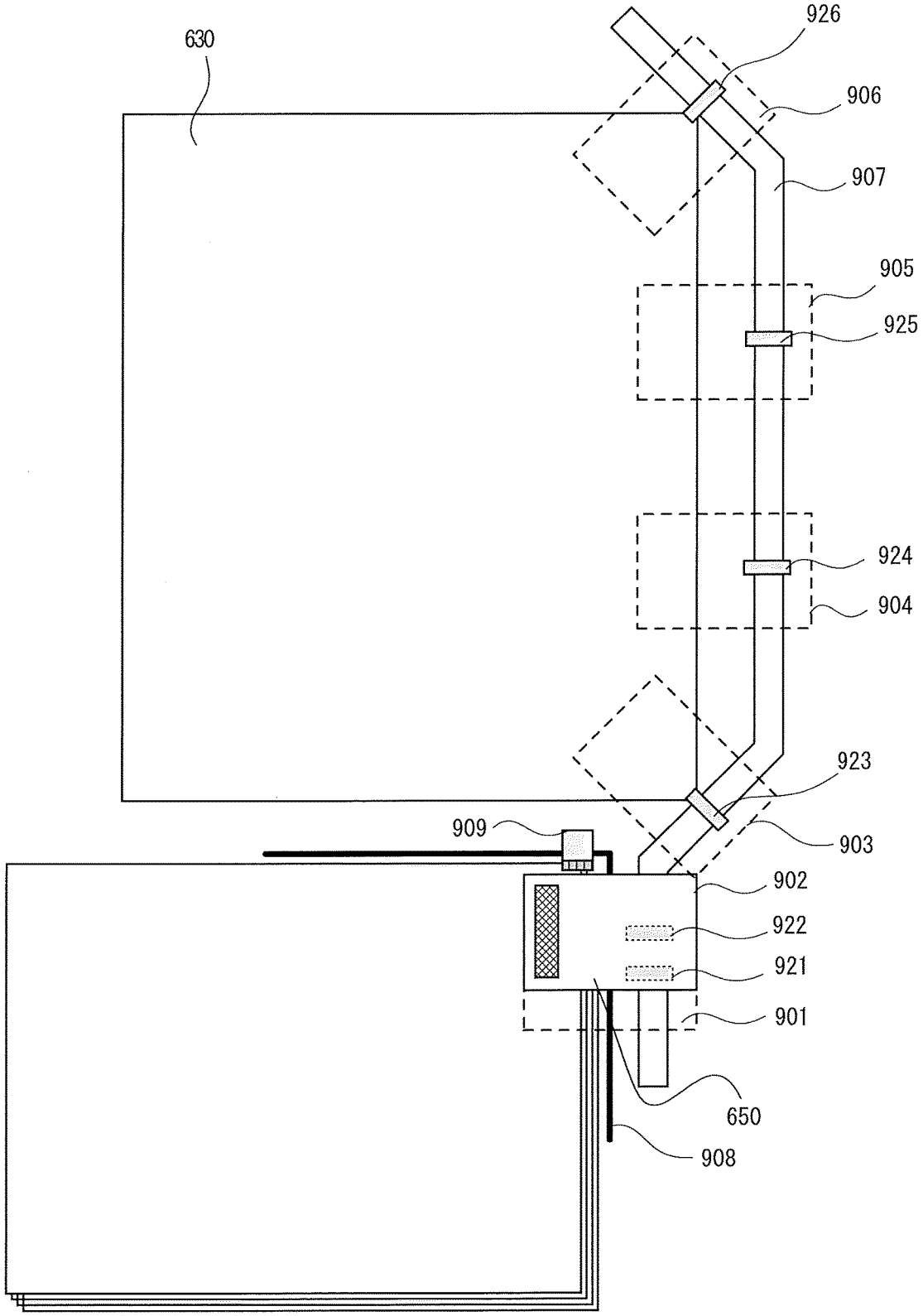
FIG. 4 is a diagram illustrating a state in which the stapler is staying at a position where the manual stapling is performed.

FIG. 4 is a diagram illustrating a state in which the stapler 650 is staying at a position where the manual stapling is performed. The opening sheet bundle sensor 909 shown in FIG. 4, arranged near a guide board 908, detects that the sheet bundle is inserted into the opening 910 of the finisher 500 from outside. In response to detecting, by the opening sheet bundle sensor 909, the insertion of the sheet bundle, the CPU 601 moves the stapler 650, staying at the home position 901, to the manual stapling position 902. Further, the stapler 650 having performed the binding processing at the manual stapling position 902 is to go back to the home position 901 again. In the following, description is given with regard to a processing procedure of the finisher 500 according to the present embodiment using FIGS. 5 and 6.

[Control Procedure According to Online Stapling Job]

Figure 5:
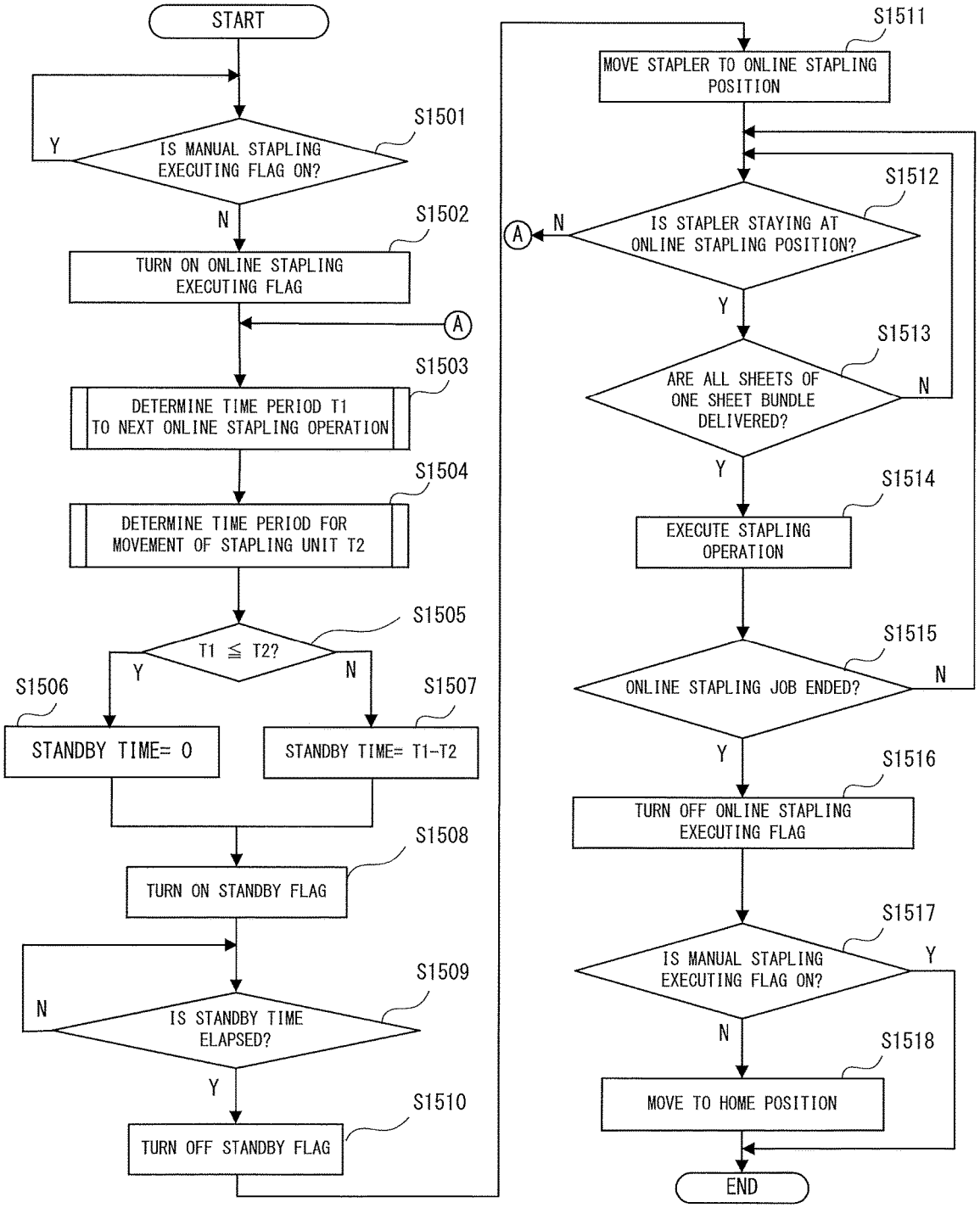
FIG. 5 is a flowchart illustrating one example of a control procedure in a case where an instruction to execute online stapling is received.

Here, description is given, using a flowchart shown in FIG. 5, with regard to a processing procedure of the control unit 600 to the stapler 650 in a case where execution of an online stapling job is instructed to the finisher 500. FIG. 5 is a flowchart indicating one example of a control procedure of the CPU 601 in a case where an instruction to execute an online stapling job is received. It is noted that there is sometimes a case where the execution of a manual stapling job is instructed while the control shown in FIG. 5 is being executed. In this case, the CPU 601 controls the stapler 650 by executing a control procedure shown in FIG. 6 (described later) in parallel. Thereby, even the online stapling job is being executed, sometimes, movement of the stapler 650 in connection with the manual stapling job is caused.

When the instruction to execute the online stapling job is received, the CPU 601 determines whether the manual stapling job is being executed or not (S1501). To determine this, a manual stapling executing flag is used. The manual stapling executing flag is a flag which represents whether the finisher 500 has received the manual stapling job or not, which is stored, for example, in the RAM 602. The flag is turned ON when the execution of the manual stapling is instructed. The flag is turned OFF when the manual stapling ends.

If it is determined that the manual stapling is being executed (S1501: Yes), the CPU 601 waits until the manual stapling ends. If not (S1501: N), the CPU 601 turns ON an online stapling executing flag. The online stapling executing flag is a flag which represents whether the finisher 500 has received the online stapling job or not (S1502). It is noted that the online stapling executing flag is stored, for example, in the RAM 602. The CPU 601 determines a time period (a first time period) T1 which is a time period to a start of a next online stapling operation (S1503). The first time period T1 decreases as time passes. It is noted that how to determine the first time period T1 will be described in the following using a table shown in FIG. 7A and a flowchart shown in FIG. 8, which are described later.

The CPU 601 determines a time period for movement (a second time period) T2, which is a time period for the stapler 650 to move from a present position it stays to an online stapling position (S1504). It is noted that how to determine the second time period T2 will be described in the following using a table shown in FIG. 7B and a flowchart shown in FIG. 9, which are described later.

The CPU 601 compares the first time period T1 with the second time period T2 (S1505). As a result of comparison, if the first time period T1 is equal to or less than the second time period T2 (S1505: Y), the CPU 601 sets standby time (time to wait for the start of movement) to "0" (zero)

(S1506). Thereby, to minimize a delay to a start of the online stapling job, the CPU 601 immediately starts to move the stapler 650 to the online stapling position.

On the other hand, if the first time period T1 is longer than the second time period T2 (S1505: N), the CPU 601 subtracts the time period for the movement T2 from the first time period T1 (T1-12). Then, the CPU 601 sets the resultant value as the standby time (S1507). In this case, even though the stapler 650 does not immediately start to move, no delay is caused in starting the online stapling job. It means that it will be after elapse of the first time period T1 from the present time that the next online stapling operation is started. Also, the timing at which the required time period to move to the online stapling position (T2) is represented by the timing at which difference in time period obtained by subtracting the time period for the movement T2 from the first time period T1 is elapsed from the present time.

Thereby, the difference in time period will be the standby time (time to wait for the start of movement) of the stapler 650.

The CPU 601 turns ON a standby flag (flag to wait for the start of movement) which represents that the stapler 650 is waiting for the start to move to the online stapling position (S1508). The CPU 601 determines whether the standby time has elapsed or not (S1509). It is noted that whether the standby time has elapsed or not is determined by using, for example, a timer (not shown). Also, while the stapler 650 is in a standby state, i.e., before the standby time elapses, the CPU 601 is capable of receiving the manual stapling job.

If it is determined that the standby time has elapsed (S1509: Y), the CPU 601 turns OFF the standby flag (S1510) and starts to move the stapler 650 to the online stapling position (S1511). That is, when the first time period T1 is decreased to the second time period T2, the standby flag is turned OFF. It is noted that, when the standby time is set to 0 (zero) in the step of S1506, the standby flag is immediately turned OFF. The CPU 601 determines whether the stapler 650 has reached the online stapling position or not (S1512). If it is determined that the stapler 650 has reached the online stapling position (S1512: Y), the CPU 601 determines whether a sheet bundle subjected to the online stapling has been received or not, i.e., all sheets of one sheet bundle have been received or not (S1513). If not (S1512: N), the CPU 601 returns to the processing of the step S1503.

If it is determined that all sheets of one sheet bundle have been received and that all sheets of the sheet bundle are delivered (S1513: Y), the CPU 601 executes stapling operation (binding operation) on the sheet bundle (S1514). If not (S1513: N), the CPU 601 returns to the processing of the step S1512.

The CPU 601 determines whether the online stapling job has ended or not (S1515). It is noted that whether to end or continue the online stapling job is determined based on the control data received from the printer section 10. If it is determined that the online stapling job continues (S1516), the CPU 601 returns to the processing of the step S1512 for the next online stapling operation. If not, i.e., if the online stapling job ended (S1515: Y), the CPU 601 turns OFF the online stapling executing flag (S1516).

The CPU 601 determines whether the manual stapling executing flag is ON or not (S1517). Even in a case where the instruction to execute the manual stapling is received while the online stapling job is being executed, there may be a case where the manual stapling cannot be executed on account of the first time period T1, which is the time period to the start of the online stapling operation. For example, in a case where the execution of the next manual stapling is standing by (S1517: Y), the stapler 650 is moved in accordance with the control procedure shown in FIG. 6. Thereby, the CPU 601 does not move the stapler 650 here and ends the online stapling job instead. Further, in a case where no execution of the manual stapling is standing by (S1517: N), the CPU 601 moves the stapler 650 to the home position 901 (S1518) and ends the online stapling job thereafter.

It is noted that, as described, if it is determined that the stapler 650 has not reached the online stapling position in the step of S1512, the CPU 601 returns to the processing of the step S1503. This is due to the fact that there may be a case where the manual stapling is executed depending on the number of sheets of the sheet bundle before all sheets of the sheet bundle subjected to the online stapling processing are delivered. Even in such a case, as long as the stapler 650 has reached the online stapling position by the next online stapling operation, no influence is given on the online stapling job. Thereby, the CPU 601 calculates again the first time period T1, which is the time period to the actual execution of the next online stapling operation (S1503). The CPU 601 also calculates the second time period T2, which is the time period for the stapler 650 to move from a present position it stays to an online stapling position (S1504). Then, the CPU 601 moves the stapler 650 to the online stapling position at appropriate timing (S1505 to S1511).

It is noted that when the online stapling job is executed on the first sheet bundle, the standby time of the stapler 650 is controlled to be appropriate beforehand. Thereby, whenever the processing of the step S1512 is performed, the stapler 650 is moved to the online stapling position.

[Control Procedure According to Manual Stapling]

Figure 6:
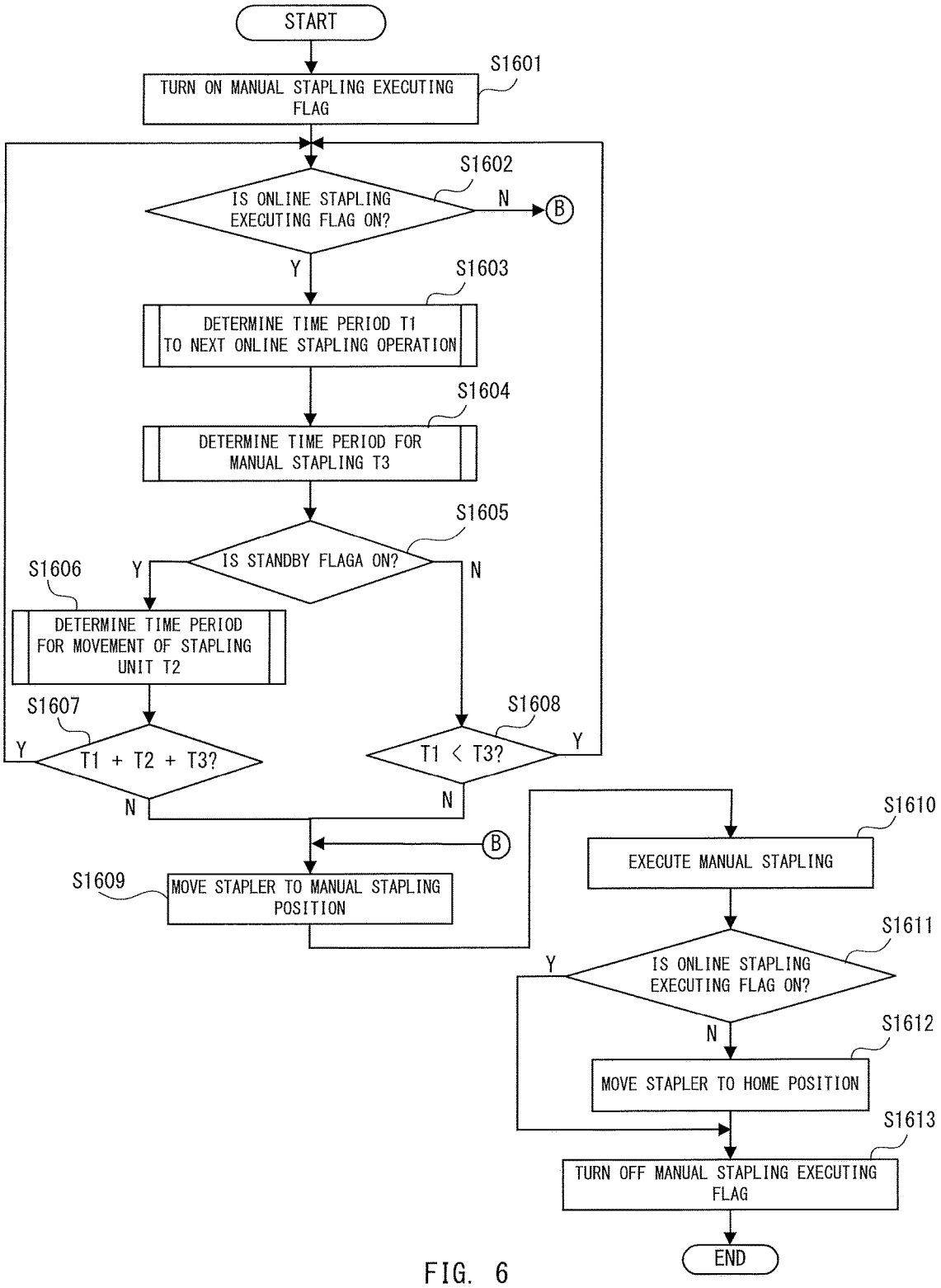
FIG. 6 is a flowchart illustrating one example of a control procedure in a case where an instruction to execute manual stapling processing is received.

Here, description is given, using a flowchart shown in FIG. 6, with regard to a processing procedure of the control unit 600 to the stapler 650 in a case where the execution of manual stapling job is instructed to the finisher 500. It is noted that in a case where a sheet bundle is inserted into the opening 910 by the user and the sheet bundle is detected by the opening sheet bundle sensor 909, the CPU 601 regards that instruction to execute the manual stapling is received.

FIG. 6 is a flowchart illustrating one example of the processing procedure of the CPU 601 in a case where the instruction to execute the manual stapling is received. When an instruction to execute the manual stapling is received, the CPU 601 turns ON the manual stapling executing flag which represents that the execution of the manual stapling is instructed (S1601). The CPU 601 determines whether the online stapling job is being executed or not (S1602). In particular, this determination is made based on whether the online stapling executing flag is ON or OFF.

If it is determined that the online stapling job is being executed, i.e., in a case where the flag is ON (S1602: Y), the CPU 601 determines the first time period T1, which is the time period to the start of the next online stapling operation (S1603). It is noted that determination of whether the stapler 650 may be moved or not in response to the instruction to execute the manual stapling depends on the operation timing of the stapler 650 which is executing the online stapling job. This is why the first time period T1 is determined at this timing. It is noted that how to determine the first time period T1 will be described later.

The CPU 601 determines a required time period T3, which is a required time period to execute one manual stapling (S1604). The required time period T3 for the manual stapling operation includes the following time periods:

(1) time period to move from the position where the stapler 650 is staying at that time to the manual stapling position; and (2) time period to go back. It is noted that how to determine the required time period T3 for the manual stapling operation will be described later using each table shown in FIGS. 7B and 7C and a flowchart shown in FIG. 10.

After determining the first time period T1 and the required time period T3, the CPU 601 determines whether the manual stapling job may be received or not. Depending on whether the stapler 650 is in a standby state (state of waiting for the start of movement) to the online stapling position (i.e., in a state in which the stapler 650 is not staying at the online stapling position) or not, the determination is made in different condition. If the stapler 650 is in a standby state, it is considered that the stapler 650 is staying at the home position 901 or at the manual stapling position 902. In this case, in addition to the first time period T1 and the required time period T3, it is necessary to consider the second time period T2, which is the time period for the stapler 650 to move to the online stapling position after the manual stapling operation. That is, in order not to give any influence on the execution of the online stapling job, a total time period of the second time period T2 required to move to the online stapling position and the required time period T3 for the manual stapling operation needs to be equal to or less than the first time period T1 (T1>=T2+T3). On the other hand, if the stapler is not in a standby state, the stapler 650 is staying at the online stapling position. Thereby, if the required time period T3 is equal to or less than the first time period T1 (T3<=T1), no influence is given on the execution of the online stapling job. Then, the CPU 601 determines whether the standby flag is ON or not (S1605).

If it is determined that the standby flag is ON (S1605: Y), the CPU 601 determines the time period T2 for the stapler 650 to move from a present position it stays to an online stapling position (S1606). It is noted that how to determine the second time period T2 will be described later.

The CPU 601 compares the first time period T1 with the total time period of the second time period T2 and the required time period T3. As a result of comparison, if the total time period of the second time period T2 and the required time period T3 exceeds the first time period T1 (T1<T2+T3) (S1607: Y), the CPU 601 returns to the processing of the step S1602 as it gives influence on the execution of the online stapling job. On the other hand, if it is determined that the standby flag is OFF (S1605: N), it is considered that the stapler 650 is staying at the online stapling position. In this case, regardless of the required time period T2 so that the CPU 601 compares the first time period T1 with the required time period T3 (S1608).

As a result of comparison, if the required time period T3 exceeds the first time period T1 (S1608: Y), the CPU 601 returns to the processing of the step S1602 as it gives influence on the execution of the online stapling job. As mentioned, in a case where no manual stapling execution is allowed, the CPU 601 repeats a series of the processing and ends the online stapling job. Alternatively, the CPU 601 waits for an increase of the first time period T1 as the job proceeds to thereby change magnitude relation between the time periods subjected for the comparison.

On the other hand, in a case where no influence is given on the execution of the online stapling job (S1607: Y or S1608: Y), the CPU 601 can execute the manual stapling job while the online stapling job is being executed. Thereby, the CPU 601 moves the stapler 650 to the manual stapling position (S1609) and executes the manual stapling operation (S1610). Thereafter, the CPU 601 determines whether the online stapling job is being executed or not (S1611). This is how the CPU 601 allows the execution of the manual stapling operation.

If it is determined that the online stapling job is not being executed (S1611: N), the CPU 601 moves the stapler 650 to the home position 901 (S1612). Thereafter, the CPU 601 turns OFF the manual stapling executing flag (S1613) and ends the manual stapling. Also, if it is determined that the online stapling job is being executed (S1611: Y), the stapler 650 is moved to the online stapling position in accordance with the control procedure shown in the flowchart of FIG. 5. Thereby, the CPU 601 turns OFF the manual stapling executing flag without moving the stapler 650 (S1613) and ends the manual stapling. It is noted that in a case where the CPU 601 does not move the stapler 650 from the manual stapling position 902, the time period capable of receiving the manual stapling job will increase during a time interval from the most recent online stapling operation to the next online stapling operation. This is because required time period to move the stapler 650 included in the required time period T3 included in the manual stapling operation is reduced.

It is noted that if the online stapling job is not being executed in the processing of the step S1601 (flag is OFF), it is not necessary to exclusively control the stapler 650 between the online stapling and the manual stapling. Thereby, when receiving the instruction to execute the manual stapling, the CPU 601 controls to start the manual stapling operation.

[How to Determine First Time Period]

Figure 8:
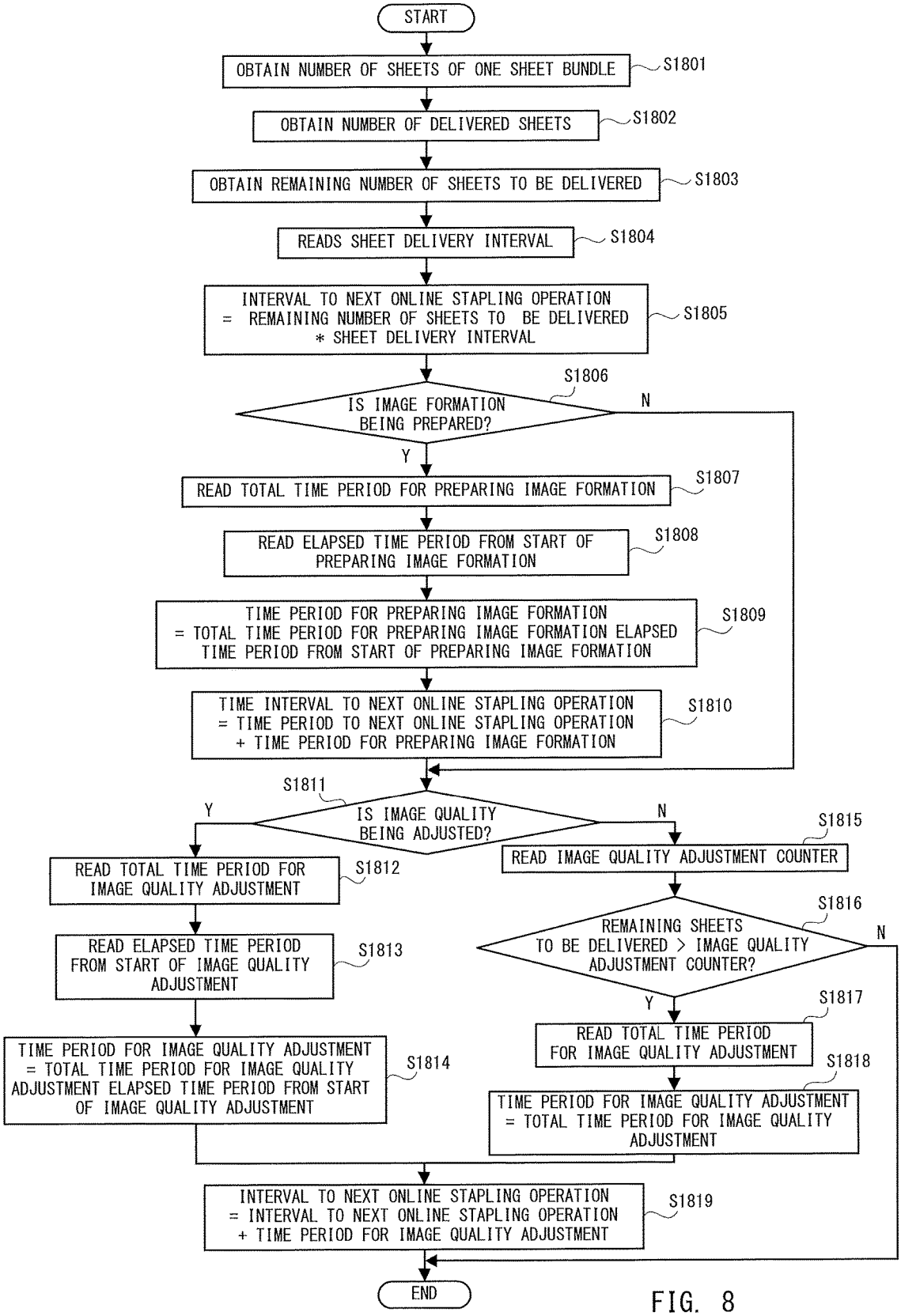
FIG. 8 is a flowchart illustrating one example of a procedure for determining a first time period which is the time period to the next online stapling operation.

Here, description is given with regard to how to determine the first time period T1 as mentioned using a table shown in FIG. 7A and a flowchart shown in FIG. 8. FIG. 7 shows one example of tables which store data representing the time period for each operation of the printer section 10 and the finisher 500. FIG. 7A is a table which stores time period for each operation of the printer section 10 is stored. The time period gives influence on interval of delivery between sheets from the printer section 10 to the finisher 500 (conveyance interval).

FIG. 8 is a flowchart illustrating one example of a procedure for determining the first time period which is the time period to the next online stapling operation. The processing corresponds to each processing of the step S1503 shown in FIG. 5 and the step S1603 shown in FIG. 6. The CPU 601 obtains the number of sheets of one sheet bundle subjected to the binding processing from the control data of the print job which is received from the control unit 200 and stored in the RAM 602 (S1801). The CPU 601 obtains the number of delivered sheets. The number represents the order of the sheet, delivered from the printer section 10, from a head sheet of the sheet bundle (S1802). Based on the number of sheets of one sheet bundle and the number of delivered sheets, the CPU 601 determines the remaining number of sheets out of the sheet bundle which is to be delivered (remaining number of sheets to be delivered) (S1803).

Based on the control data of the print job received from the control unit 200, the CPU 601 reads an interval between sheets at which a sheet is delivered (sheet delivery interval) from the printer section 10 in accordance with the table shown in FIG. 7A (S1804). It is noted that the sheet delivery time (interval) varies depending on sheet size. It also varies whether it is in single-sided image forming mode or double-sided image forming mode. Based on the remaining number of sheets to be delivered and the sheet delivery interval, the CPU 601 determines the first time period T1 which is the time period to the next online stapling operation (S1805).

The CPU 601 determines whether or not the printer section 10 is in "image formation being prepared" state, in which state, the printer section 10 starts up the processing unit 101 or various motors (S1806). It is noted that a time period for preparing the image formation can be added to the first time period T1 which is the time period to the next online stapling operation. This is because, if the printer section 10 is in "image formation being prepared" state, during that period, no sheet is delivered to the finisher 500 and no online post-processing is performed.

To determine the time period for preparing the image formation, the CPU 601 reads total time period required, by the printer section 10, for preparing the image formation (total time period for preparing the image formation) in accordance with the table shown in FIG. 7A (S1807). It is noted that the length of time period for preparing the image formation varies depending on an apparatus installation environment, such as temperature, humidity and the like. Based on the control data of the print job received, the CPU 601 reads elapsed time period from the start of preparing the image formation (S1808). This is how the CPU 601 grasps progress of preparation of the image formation. Also, the time period obtained by subtracting the elapsed time period from the start of preparing the image formation from the total time period for preparing the image formation is the remaining time period for preparing the image formation. Thereby, based on the two types of time periods read, i.e., (1) total time period for preparing the image formation, and (2) elapsed time period from the start of preparing the image formation, the CPU 601 determines the time period for preparing the image formation (S1809). Then, the time period for preparing the image formation obtained in this manner is added to the first time period T1 which is the time period to the next online stapling operation (S1810).

Here, if the printer section 10 is in "image quality being adjusted" state or image quality adjustment is performed before completion of the image formation on the final sheet of the same sheet bundle, the time period for performing the image quality adjustment can also be added to the first time period T1 which is the time period to the next online stapling operation. It means that the image formation of the print job cannot be performed while the image quality adjustment is being performed by the printer section 10. This results in increasing the interval between sheets delivered to the finisher 500 by the time period used for the image quality adjustment performed by the printer section 10. Due to this, the time period used for the image quality adjustment performed by the printer section 10 can be adapted for the time period for the manual stapling operation.

Based on the control data of the print job received, the CPU 601 determines whether the printer section 10 is performing the image quality adjustment or not (S1811). If it is determined that the printer section 10 is executing the image quality adjustment (S1811: Y), the CPU 601 reads the total time period for the image quality adjustment corresponding to the image quality adjustment being executed in accordance with the table shown in FIG. 7A (S1812). The length of time period for the image quality adjustment varies depending on the types of the image quality adjustment to be executed. Based on the control data of the print job received, the CPU 601 reads elapsed time period from the start of the image quality adjustment (S1813). Thereby, the CPU 601 can grasp progress of the image quality adjustment. Also, the time period obtained by subtracting the elapsed time period from the start of the image quality adjustment from the total time period for the image quality adjustment is the remaining time period for the image quality adjustment.

Thereby, based on the two types of time periods read, i.e., (1) a total time period for the image quality adjustment, and (2) an elapsed time period from the start of the image quality adjustment, the CPU 601 determines the time period for the image quality adjustment (S1814).

On the other hand, even in a case where the printer section 10 is not performing the image quality adjustment (S1811: N), in a case where the image quality adjustment is executed before completion of the image formation on the final sheet of the same sheet bundle currently being processed, the first time period T1 which is the time period to the next online stapling operation is increased by the time period used for the image quality adjustment. Based on the control data of the print job received, the CPU 601 reads image quality adjustment counter which represents the remaining number of sheets before the image quality adjustment is executed (S1815). The CPU 601 determines whether the remaining number of sheets to be delivered is greater than the image quality adjustment counter (S1816). If it is determined that it is greater than the image quality adjustment counter (S1816: Y), it means that the image quality adjustment is to be executed before completion of the image formation on the final sheet of the same sheet bundle currently being processed. As a result of comparison, if the image quality adjustment is not executed before completion of the image formation on at least the final sheet of the same sheet bundle currently being processed (S1816: N), the CPU 601 ends to determine the first time period T1.

On the other hand, if it is determined that the image quality adjustment is executed before completion of the image formation on the final sheet of the same sheet bundle currently being processed (S1816: Y), the CPU 601 reads, in accordance with the table shown in FIG. 7A, the total time period for the image quality adjustment corresponding to the image quality adjustment to be executed (S1817). Thereafter, the CPU 601 obtains the time period for the image quality adjustment for the image quality adjustment subjected to be executed (S1818).

The CPU 601 adds the time period for the image quality adjustment to the first time period T1 which is the time period to the next online stapling operation (S1819). It is noted that the types of the operation or numerical values in the table in FIG. 7A are only the example. The present invention is not limited to these types of operation or numerical values.

Figure 9:
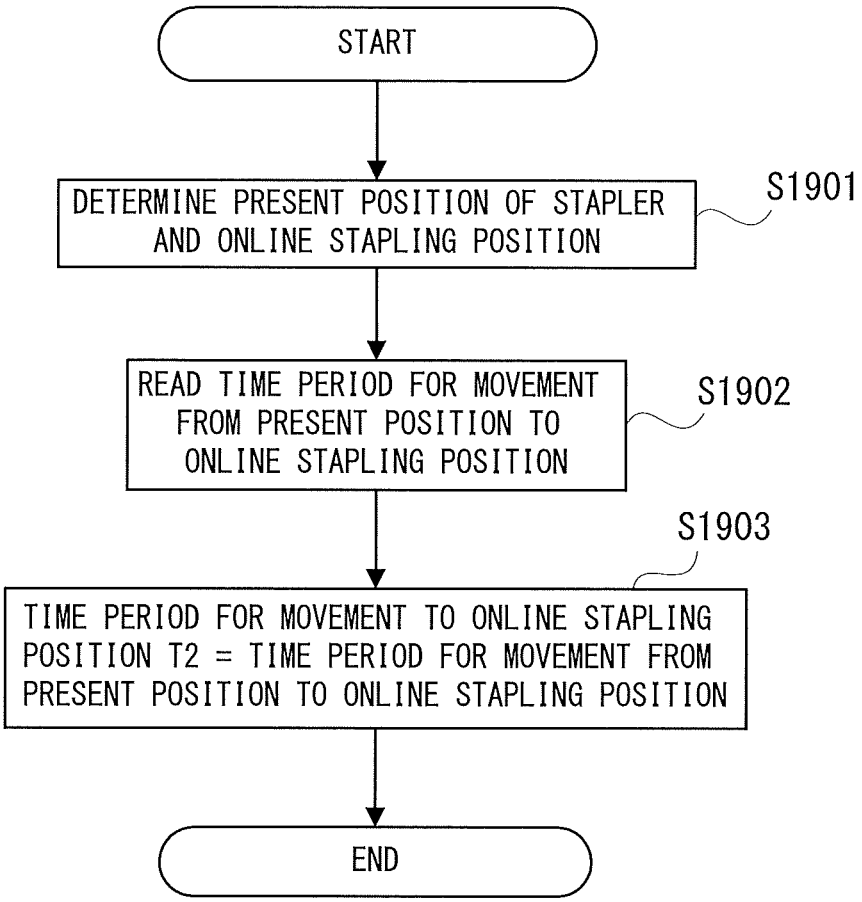
FIG. 9 is a flowchart illustrating one example of a procedure for determining the time period for a movement required when moving from a position where the stapler stays to an online stapling position.

Here, description is given with regard to how to determine the second time period T2 as previously mentioned using a table shown in FIG. 7B and a flowchart shown in FIG. 9. FIG. 7B is a table in which a time period for the stapler 650 to move from each moving source position to other moving destination is stored.

FIG. 9 is a flowchart illustrating one example of a procedure for determining the required time period when the stapler 650 moves from a position where it stays to an online stapling position. The processing corresponds to each processing of the step S1504 shown in FIG. 5 and the step S1606 shown in FIG. 6. The CPU 601 determines a present position of the stapler 650 it stays (present position) and a position where the online stapling is to be executed (S1901). The CPU 601 reads the time period for the stapler 650 to move from a present position it stays to an online stapling position in accordance with the table shown in FIG. 7B (S1902). It is noted that the value in the table shown in FIG. 7B is previously measured or calculated and stored, for example, in the ROM 605. The CPU 601 determines the value read as the second time period T2, for the stapler 650 to move to the online stapling position (S1903). It is noted that the numerical values shown in the table in FIG. 7B are only the example. The present invention is not limited to these numerical values.

[How to Determine Time Period for Manual Stapling]

Figure 10:
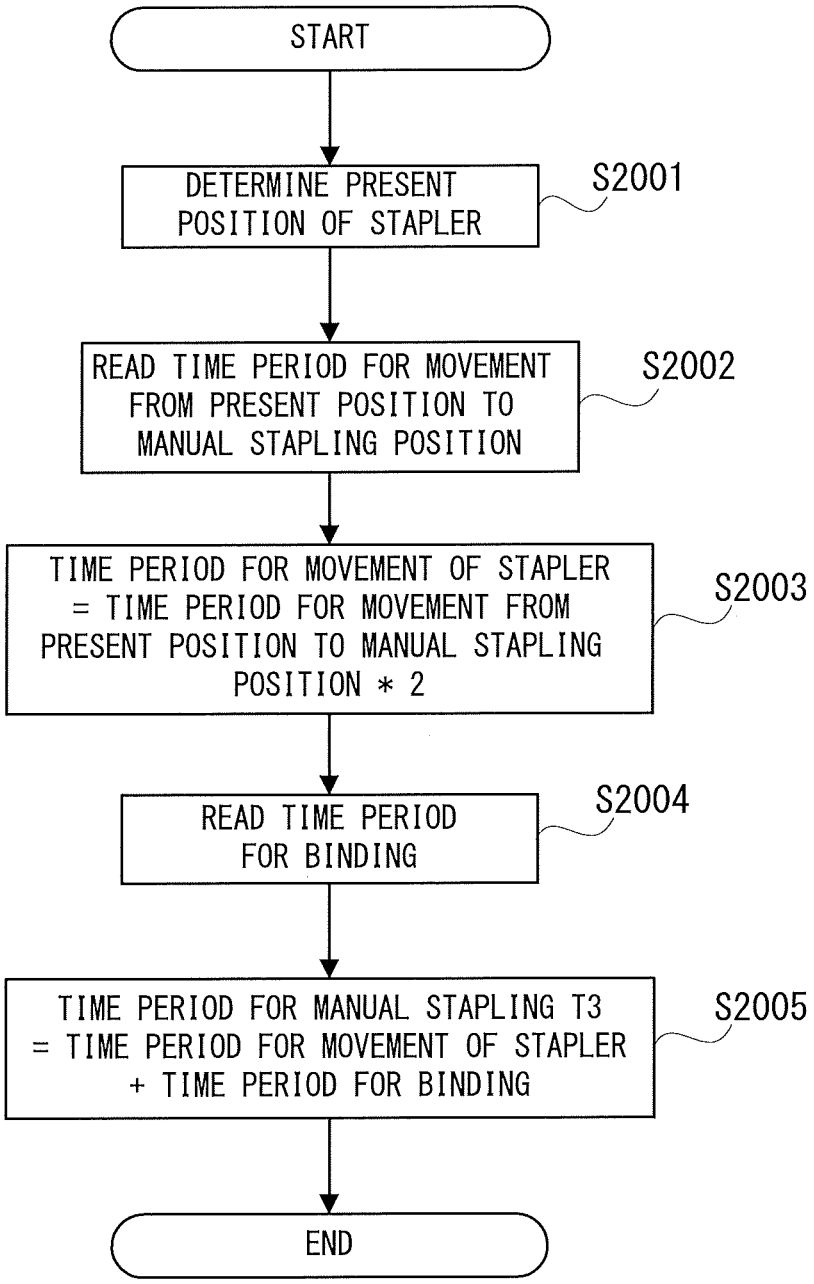
FIG. 10 is a flowchart illustrating one example of a procedure for determining the time period for the manual stapling.

Here, description is given with regard to how to determine the required time period T3 as mentioned using tables shown in FIGS. 7B and 7C and a flowchart shown in FIG. 10. FIG. 7C is a table in which time period for the stapler 650 to perform various types of binding operation is stored.

FIG. 10 is a flowchart illustrating one example of a procedure for determining the time period for the manual stapling. This processing corresponds to the processing of Step S1604 shown in FIG. 6. It is noted that the time period for the manual stapling represents total time periods of following (1), (2) and (3). That is, (1) a time period for the stapler 650 to move from a present position it stays to the manual stapling position 902;

(2) a time period for the stapler 650 to perform the stapling operation; and (3) a time period for the stapler 650 to go back from the manual stapling position 902 to the original online stapling position.

The CPU 601 determines the present position of the stapler 650 it stays (present position) (S2001). The CPU 601 reads the time period for the stapler 650 to move from a present position it stays to the manual stapling position 902 in accordance with the table shown in FIG. 7B (S2002). Here, it is assumed that a time period for the stapler 650 for reciprocating movement between the present position and the manual stapling position is twice as long as the time period for movement read. The CPU 601 determines the time period for the stapler for movement (stapler movement time) (S2003).

The CPU 601 reads the time period for the stapling operation for the manual stapling (S2004). The total time period of the time period for the stapler 650 for movement and the time period for the stapling operation is the time period for the manual stapling. Thereby, the CPU 601 adds the two types of time periods and determines the time period thus obtained as the required time period T3 for the manual stapling operation (S2005). It is noted that the numerical values shown in the table in FIG. 7C are only the example. The present invention is not limited to these numerical values.

As mentioned, with the image forming system S according to the present embodiment, it is possible to optimize time period capable of receiving manual stapling job while the online stapling job is being executed. This enables to extend time period capable of receiving the manual stapling job without increasing waiting time of a user of the online stapling function. Thereby, it is possible to respectively balance convenience of user using a manual stapling and convenience of user using an online stapling.

As mentioned, according to the present disclosure, a post-processing apparatus which can respectively balance convenience of user using a manual staple and convenience of user using an online staple is provided. Further, an image forming system including the post-processing apparatus is provided. Further, according to the present disclosure, it is possible to respectively balance convenience of user using a manual staple and convenience of user using an online staple. It is noted that the present invention has been described in detail by way of the above-mentioned embodiments, but the scope of the present invention is not limited to those embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-204184, filed Oct. 2, 2014 and 2015-181610, filed Sep. 15, 2015, which are hereby incorporated by reference wherein in their entirety.

What is claimed is:

1. A post-processing apparatus comprising:

a post-processing unit configured to perform predetermined post-processing on a sheet;

a moving unit configured to move the post-processing unit to a first processing position where first processing is performed or to a second processing position where second processing is performed, wherein in the first processing, the predetermined post-processing is performed on a sheet which is conveyed from an image forming apparatus, and in the second processing, the predetermined post-processing is performed on a sheet which is manually inserted; and a control unit configured to control the post-processing unit to start moving after a difference in time between a first time period and a second time period is elapsed in a case where the first time period, which is a time period to next execution of the predetermined post-processing in the first processing, is greater than the second time period, which is a time period for the post-processing unit to move to the first processing position.

2. The post-processing apparatus according to claim 1, further comprising a determination unit configured to determine the first time period using at least one of a third time period, a fourth time period, and a fifth time period, wherein the third time period is a time period determined by the number of sheets of one sheet bundle subjected to the predetermined post-processing and conveyance interval of sheet which is conveyed from the image forming apparatus, the fourth time period is a time period for preparing an image formation in the image forming apparatus, and the fifth time period is a time period for image quality adjustment in the image forming apparatus.

3. The post-processing apparatus according to claim 1, further comprising a detection unit configured to detect a position of the post-processing unit, wherein the control unit is further configured to allow execution of the second processing, in a case where the position of the post-processing unit detected by the detection unit is not at the first processing position and the first time period is greater than a total time period of a first required time period and a second required time period, the first required time period is a time period for the post-processing unit to move from the position of the post-processing unit detected by the detection unit to the first processing position, and the second required time period is a time period for the post-processing unit to reciprocally move between the position detected by the detection unit and the second processing position.

4. The post-processing apparatus according to claim 3, wherein the control unit is further configured to allow execution of the second processing, in a case where the post-processing unit is positioned at the first processing position and the first time period is greater than the second required time period.

5. The post-processing apparatus according to claim 3, wherein the control unit is further configured to prohibit execution of the second processing, in a case where the position of the post-processing unit detected by the detection unit is not the first processing position and the first required time period is smaller than a total time period of the first required time period and the second required time period.

6. The post-processing apparatus according to claim 5, wherein the control unit is further configured to prohibit execution of the second processing, in a case where the post-processing unit is positioned at the first processing position and the first time period is smaller than the second required time period.

7. The post-processing apparatus according to claim 1, wherein the control unit is further configured to allow execution of the second processing, in a case where the first processing is not being executed.

8. An image forming system including an image forming apparatus for forming an image on a sheet and a post-processing apparatus for performing predetermined post-processing on a sheet, wherein the post-processing apparatus comprises:

a post-processing unit configured to perform predetermined post-processing on a sheet;

a moving unit configured to move the post-processing unit to a first processing position where first processing is performed or to a second processing position where second processing is performed, wherein in the first processing, the predetermined post-processing is performed on a sheet which is conveyed from the image forming apparatus, and in the second processing, the predetermined post-processing is performed on a sheet which is manually inserted; and a control unit configured to control the post-processing unit to start moving after a difference in time between a first time period and a second time period is elapsed, in a case where the first time period, which is a time period to next execution of the predetermined post-processing in the first processing, is greater than the second time period, which is a time period for the post-processing unit to move to the first processing position.

9. A post-processing apparatus comprising:

a binding unit configured to perform binding processing on a sheet bundle formed of a plurality of sheets;

a moving unit configured to move the binding unit to an online stapling position where binding processing is performed on a sheet which is conveyed from an image forming apparatus or a manual stapling position where binding processing is performed on a sheet which is manually inserted; and a control unit configured to control the binding unit to start moving after a difference in time between a first time period and a second time period is elapsed in a case where the first time period, which is a time period to next execution of the binding processing at the online stapling position, is greater than the second time period, which is a time period for the binding unit to move to a processing position where the next binding processing is executed.

10. The post-processing apparatus according to claim 9, further comprising a determination unit configured to determine the first time period using at least one of a third time period, a fourth time period, and a fifth time period, wherein the third time period is a time period determined by the number of sheets of the one sheet bundle subjected to the binding processing and conveyance interval of sheet which is conveyed from an image forming apparatus, the fourth time period is a time period for preparing an image formation in the image forming apparatus, and the fifth time period is a time period for image quality adjustment in the image forming apparatus.

11. The post-processing apparatus according to claim 9, further comprising a detection unit configured to detect a present position of the binding unit, wherein the binding processing performed on a sheet conveyed from the image forming apparatus is configured to allow setting a plurality of online stapling positions in a binding operation performed on one sheet bundle, the control unit is further configured to allow execution of the second processing, in a case where the position of the binding unit detected by the detection unit is not the online stapling position and the first time period is greater than a total time period of a first required time period, the first required time period is a time period for the binding unit to move from the position of the binding unit detected by the detection unit to the online stapling position, and the second required time period is a time period for the binding unit to reciprocally move between the position of the binding unit detected by the detection unit and the manual stapling position.

12. The post-processing apparatus according to claim 11, wherein the control unit is further configured to allow execution of the binding processing on the sheet which is manually inserted, in a case where the binding unit is positioned at the online stapling position and the first time period is greater than the second required time period.

13. The post-processing apparatus according to claim 11, wherein the control unit is further configured to prohibit execution of the binding processing on the sheet which is manually inserted, in a case where the position of the binding unit detected by the detection unit is not the online stapling position and the first time period is smaller than the sum of the first required time period and the second required time period.

14. The post-processing apparatus according to claim 13, wherein the control unit is further configured to prohibit execution of the binding processing on the sheet which is manually inserted, in a case where the binding unit is positioned at the online stapling position and the first time period is smaller than the second required time period.

15. The post-processing apparatus according to claim 9, wherein the control unit is further configured to allow execution of binding processing on the sheet which is manually inserted, in a case where binding processing is not executed on a sheet which is conveyed from the image forming apparatus.

* * * * *